US007624985B2

(12) United States Patent
Majima et al.

(10) Patent No.: US 7,624,985 B2
(45) Date of Patent: Dec. 1, 2009

(54) REEL ASSEMBLY AND GAMING MACHINE COMPRISING THE SAME

(75) Inventors: Shiro Majima, Zama (JP); Masayuki Seto, Zama (JP)

(73) Assignee: Konami Gaming Incorporated, Las Vegas, NV (US)

( * ) Notice: Subject to any disclaimer, the term of this patent is extended or adjusted under 35 U.S.C. 154(b) by 470 days.

(21) Appl. No.: 11/566,690

(22) Filed: Dec. 5, 2006

(65) Prior Publication Data

US 2008/0128542 A1 Jun. 5, 2008

(51) Int. Cl.
*G07F 17/34* (2006.01)

(52) U.S. Cl. ..... 273/143 R; 273/138.2

(58) Field of Classification Search ..... 273/143 R, 273/138.2; 463/20
See application file for complete search history.

(56) References Cited

U.S. PATENT DOCUMENTS

| | | | | |
|---|---|---|---|---|
| 4,928,964 | A * | 5/1990 | Nakamura | 273/143 R |
| 6,133,655 | A | 10/2000 | Suzuki et al. | |
| 6,998,805 | B2 | 2/2006 | Nireki et al. | |
| 7,038,411 | B2 | 5/2006 | Nireki et al. | |
| 2004/0222760 | A1 * | 11/2004 | Nireki et al. | 318/362 |
| 2004/0224752 | A1 | 11/2004 | Nireki et al. | |
| 2005/0104288 | A1 | 5/2005 | Omomo | |

FOREIGN PATENT DOCUMENTS

| | | | |
|---|---|---|---|
| JP | 6-284682 | A | 10/1994 |
| JP | 2533195 | B2 | 6/1996 |
| JP | 2533196 | B2 | 6/1996 |
| JP | 2579691 | B2 | 11/1996 |
| JP | 2002-357245 | A | 12/2002 |
| JP | 3093023 | U | 1/2003 |

* cited by examiner

*Primary Examiner*—Benjamin H Layno
(74) *Attorney, Agent, or Firm*—Global IP Counselors, LLP

(57) ABSTRACT

A reel assembly of the invention includes a first elastic member capable of axial and circumferential deformation at the joint between a motor shaft and a reel. A motor exerts torque on the reel through circumferential deformation of the first elastic member, which absorbs circumferential vibrations of the reel at a stop position. A fastening member coupled to the shaft includes a second elastic member capable of axial deformation. The fastening member presses the second elastic member against the reel in the axial direction to secure the reel on the shaft and compress the first elastic member. The second elastic member absorbs axial vibrations of the reel at a stop position. When the first elastic member is made of elastomer, its circumferential elasticity varies with axial compressions, and accordingly, the circumferential elasticity is easy to optimize in order to absorb the circumferential vibrations of a reel of whatever size and weight.

7 Claims, 19 Drawing Sheets

REEL ASSEMBLY AND GAMING MACHINE COMPRISING THE SAME

BACKGROUND OF THE INVENTION

1. Field of the Invention

The present invention relates to a gaming machine, and in particular, a reel assembly installed in the gaming machine. Such gaming machines include slot machines, poker machines, "pachislot" machines, and roulette machines. In addition, a mechanism of the reel assembly is used in other devices, such as a beverage vending machine having a roulette-like function.

2. Background Information

Some gaming machines such as slot machines and roulette machines are equipped with one or more mechanical reels or wheels (hereafter, collectively referred to as reels), which spin and randomly change the positions of symbols displayed on the surfaces thereof visible to players. Players may be able to win money (credits) or bonuses based upon the positions of the symbols when the reels come to a stop.

In general, electric motors, preferably stepping motors, rotate the reels under the control executed by a microcomputer. This allows the reels to spin at various rates, in the reverse direction, and with a high degree of precision, and thereby to produce various visual effects which entertain players.

Enhancing the visual effects requires more quick and accurate response from the spinning reels. In particular, the reels must come to a complete stop more quickly, i.e., vibrations of the reels must be quickly removed at a stop position. In some conventional reel assemblies, a weight disc is coupled to the shaft of a stepping motor through an elastic member (see Japan Patent Nos. 2533195, 2533196, and 2579691, and Japan Registered Utility Model No. 3093023). The rotational inertia of the weight disc reduces the circumferential vibrations of a reel at a stop position. The elastic member may be an elastomer or a spring, and allowed to be deformed in the circumferential directions of the shaft in the joint between the shaft and the weight disc. The stepping motor exerts torque on the weight disc through circumferential deformation of the elastic member, which absorbs circumferential vibrations of the weight disc (and accordingly, those of the reel) at a stop position. In another conventional reel assembly, an elastomer connects between the tip of the driving shaft of a stepping motor and the driven axis of a reel (see Japan Published Patent Application No. 2002-357245). The elastomer is allowed to be deformed in the circumferential directions. The stepping motor exerts torque on the driven axis through circumferential deformation of the elastomer, which absorbs circumferential vibrations of the reel at a stop position.

In order to enhance the visual effects, it is also important that axial vibrations of reels be reduced. In some conventional reel assemblies, a spring or stator coils of a stepping motor continuously pushes the rotor of the stepping motor in the axial direction by elastic or magnetic forces (see Japan Published Patent Application No. H06(1994)-284682 and U.S. Pat. No. 6,133,655). The elastic or magnetic forces reduce axial vibrations of the rotor and the shaft.

In the above-mentioned conventional reel assemblies, elastic members are used in the absorption of axial and circumferential vibrations of the reels at a stop position. However, the elastic forces of the elastic members and the vibration modes of the reels will easily vary in accordance with dimensional and assembly deviations in the components, the degrees of elasticity of the elastic members, operating conditions, ambient temperatures, and the like. Accordingly, the ability to reduce vibrations will vary widely in accordance with the assemblies and time. In addition, gaming machines (especially those used in casinos) require frequent model changes, and thus the structure of reel assemblies should be simple in order to enhance maintainability. This prevents the conventional reel assemblies from increasing the reliability of the spinning motions of the reels.

In view of the above, it will be apparent to those skilled in the art from this disclosure that there exists a need for an improved reel assembly that reduces the axial and circumferential vibrations of a reel quickly and reliably at a stop position by using a simple structure, and thereby increasing the reliability of the spinning motions of the reel and enhancing the visual effects of a gaming machine equipped with the reel assembly. This invention addresses this need in the art as well as other needs, which will become apparent to those skilled in the art from this disclosure.

SUMMARY OF THE INVENTION

A reel assembly according to one aspect of the present invention preferably comprises a motor, a reel, a joint between the shaft and the reel, and a fastening member. The motor includes a shaft. The reel is configured to be rotatably coupled to the shaft. The joint includes a first elastic member that is deformable in the axial and circumferential directions of the shaft. The motor exerts torque on the reel through elastic deformation of the first elastic member in the circumferential direction. The elastic deformation of the first elastic member absorbs the circumferential vibrations of the reel quickly and reliably at a stop position. The fastening member is coupled to the tip of the shaft, and includes a second elastic member that is deformable in the axial direction. The fastening member is configured to press the reel in the axial direction through elastic deformation of the second elastic member, and thereby secure the reel on the shaft and compress the first elastic member in the axial direction. The elastic deformation of the second elastic member absorbs axial vibrations of the reel quickly and reliably at a stop position. The two types of elastic members are combined in a simple structure. Therefore, the reel assembly has a higher degree of maintainability and reliability. Preferably, a plurality of the reel assemblies are installed in a gaming machine, and thereby facilitate the enhancement of visual effects by using the quick and reliable spinning motions of the reels.

The first elastic member is preferably made of an elastomer. In this case, the circumferential elasticity of the first elastic member varies with the axial deformation thereof, and is easily optimized for absorbing the circumferential vibrations of a reel of whatever size and weight. This further enhances the reliability of the reel assembly. In particular, when the reel assembly is installed in a gaming machine, the reel assembly can maintain a higher degree of reliability, regardless of frequent model changes in the gaming machine.

The elasticity of the first elastic member and the vibration modes of the reel are easy to vary in accordance with the dimensional and assembly deviations of components, operational and environmental conditions, time, etc. The fastening member preferably allows the length of the second elastic member to be adjusted in the axial direction. More preferably, a thread is formed at the tip of the shaft, and the fastening member includes a screw or nut coupled to the thread. In this case, the screw or nut coupled to the thread presses the second elastic member against the reel, and determines the axial length of the second elastic member. The adjustment in the axial length of the second elastic member can compensate for fluctuations in the elasticity of the first elastic member and the vibration modes of the reel. This further enhances the maintainability of the reel assembly. In particular, when the reel assembly is installed in a gaming machine, the reel assembly can maintain a higher degree of reliability, regardless of frequent model changes in the gaming machine.

The second elastic member preferably comprises a coil spring, or alternatively, may comprise a conical spring washer. In this case, the axial length of the second elastic member can be designed and adjusted within wider ranges. This flexibility can facilitate the reduction of the various vibration modes of the reel within wider ranges in elasticity of the first elastic members.

In the case where the second elastic member is configured to be deformed in the circumferential direction by the friction between the second elastic member and the reel, the second elastic member can help the first elastic member absorb circumferential vibrations of the reel. In this case, the second elastic member is preferably concentric with the shaft. Alternatively, the fastening member may include a plate positioned between the second elastic member and the reel. A protrusion and a depression may be formed on the surfaces of the plate and the reel that are in contact with each other, respectively, or vice versa. The plate reduces the friction between the second elastic member and the reel within an appropriate range, and thereby prevents the second elastic member from excessively delaying the spinning reel.

A reel assembly according to another aspect of the present invention comprises a motor, a reel, a joint between the shaft and the reel, and a fastening member coupled to the tip of the shaft. The motor includes a shaft. The reel is configured to be rotatably coupled to the shaft. Through the joint, the motor exerts torque on the reel. The fastening member includes two coil springs concentric with the shaft and wound in opposite circumferential directions of the shaft. The two coil springs are further deformable in the axial direction of the shaft. The fastening member is configured to press the reel in the axial direction through elastic deformation of the coil springs and thereby secure the reel on the shaft. The elastic deformation of the two coil springs absorbs axial vibrations of the reel quickly and reliably at a stop position. The two coil springs also exert torque on the reel in opposite directions by means of friction and elasticity in torsion, and thereby complement each other in the quick and reliable reduction of circumferential vibrations of the reel at a stop position. The two coil springs are combined in the simple structure described above. Therefore, the reel assembly has a higher degree of maintainability and reliability. Preferably, a plurality of the reel assemblies are installed in a gaming machine, and thereby facilitate the enhancement of visual effects by using the quick and reliable spinning motions of the reels. In addition, the axial and circumferential elasticity of the two coil springs can be designed with more flexibility by selecting their sizes and materials. Accordingly, the elasticity of the two coil springs is easy to optimize in order to absorb both the axial and circumferential vibrations of a reel of whatever size and weight. This further enhances the reliability of the reel assembly. In particular, when the reel assembly is installed in a gaming machine, the reel assembly can maintain a higher degree of reliability, regardless of frequent model changes in the gaming machine.

The elasticity of the two coil springs and the vibration modes of the reel are easy to vary in accordance with the dimensional and assembly deviation of components, operational and environmental conditions, time, etc. The fastening member preferably allows the lengths of the two coil springs to be adjusted in the axial direction. More preferably, a thread is formed at the tip of the shaft, and the fastening member includes a screw or nut coupled to the thread. In this case, the screw or nut coupled to the thread presses the two coil springs against the reel, and determines the axial lengths of the two coil springs. The adjustment in axial length of the two coil springs can compensate for the fluctuations of the elasticity thereof and the vibration modes of the reel. This further enhances the maintainability of the reel assembly. In particular, when the reel assembly is installed in a gaming machine, the reel assembly can maintain a higher degree of reliability, regardless of frequent model changes in the gaming machine. In addition, the axial lengths of the two coil springs can be designed and adjusted within wider ranges. This flexibility can facilitate the reduction of the various vibration modes of the reel within wider ranges in the elasticity of the coil springs.

The fastening member may include a plate positioned between the two coil springs and the reel. A protrusion and a depression may be formed on the surfaces of the plate and the reel that are in contact with each other, respectively, or vice versa. The plate reduces the friction between the two coil springs and the reel within an appropriate range, regardless of the dimensional and assembly deviation in the components, operational and environmental conditions, time, etc., and thereby prevents the two coil springs from excessively delaying the spinning reel.

The reel assembly according to any of the above two aspects of the present invention may further comprise a lubricating layer positioned on one of the radially opposed surfaces of the reel and the shaft or between the surfaces thereof. In the case where the shaft is inserted in a hole opened at the center axis of the reel, the lubricating layer is positioned on either or both of the outer surface of the shaft and the inner surface of the hole, or between the surfaces thereof. Here, the lubricating layer is preferably made of a lubricant, or alternatively may be a low-friction material integrated into one of the shaft and the reel, or formed separately from both of them. The lubricating layer reduces the friction between the shaft and the reel, and thereby maintains the friction at a substantially constant level regardless of the dimensional and assembly deviation in the components, operational and environmental conditions, time, etc. This facilitates the design and adjustment in the axial length of the second elastic member and the two coil springs, and thus enhances the maintainability and reliability of the reel assembly.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

BEST MODE FOR CARRYING OUT THE INVENTION

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Embodiment 1

Figure 1:
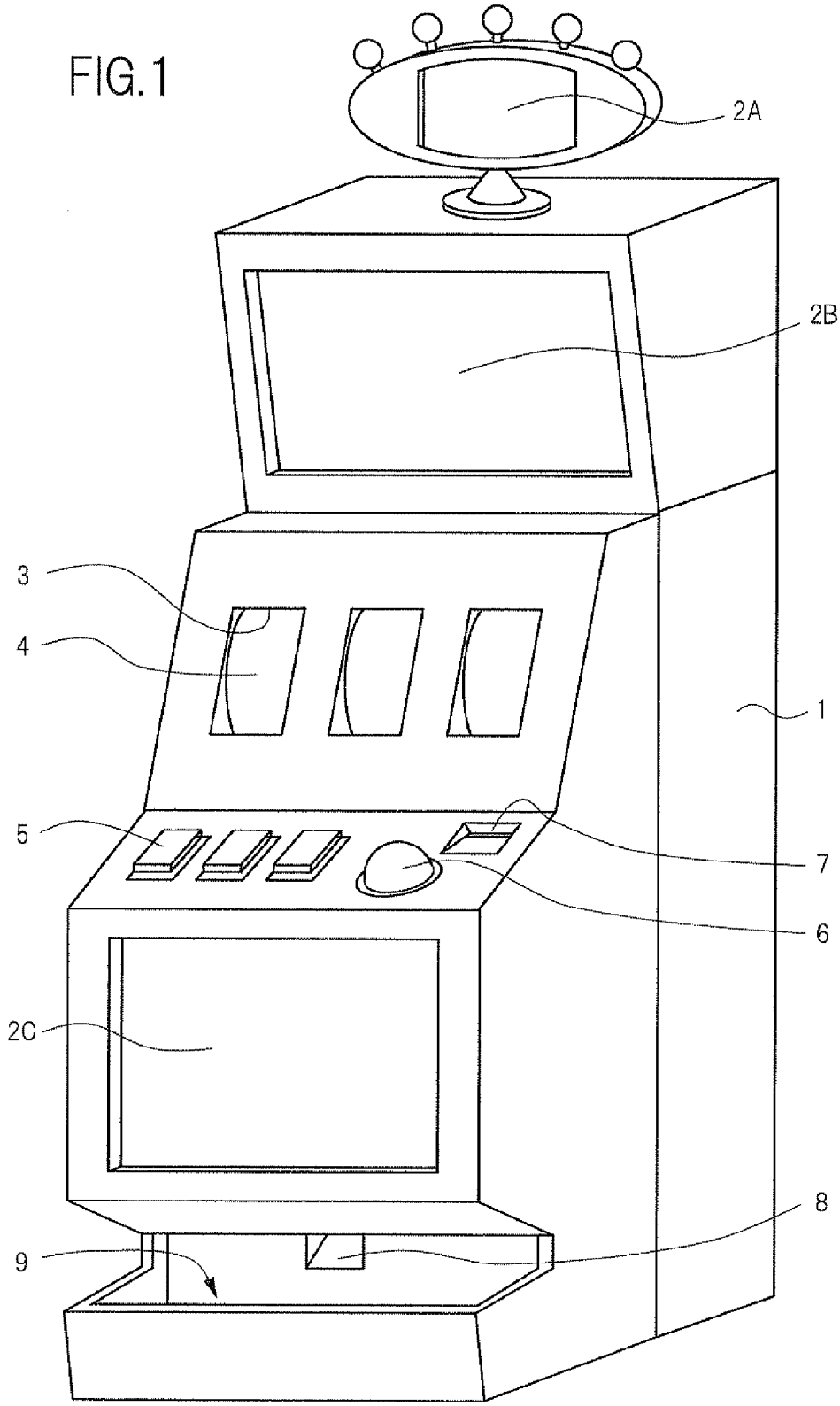
FIG. 1 is a perspective view of a stepper-reel slot machine according to the present invention.

A first embodiment of a reel assembly according to the present invention is preferably installed in a stepper-reel slot machine installed in an amusement arcade or a casino as shown in FIG. 1. The components of this slot machine visible from the exterior include a cabinet 1, three display units 2A, 2B, 2C, three reels 4, operation buttons 5, a spin button 6, a coin inlet 7, a coin outlet 8, and a coin receiver 9. Control units for these components are installed inside the cabinet 1 (not shown in the figures).

The three display units 2A, 2B, and 2C each reproduce images, which include, for example, images for use in decoration such as the logo of a game developer, images for use in advertisements, images for use in visual effects in games, and visualized information on games such as pay tables, illustrations of game content, bets, and the number of credits available.

Figure 2:
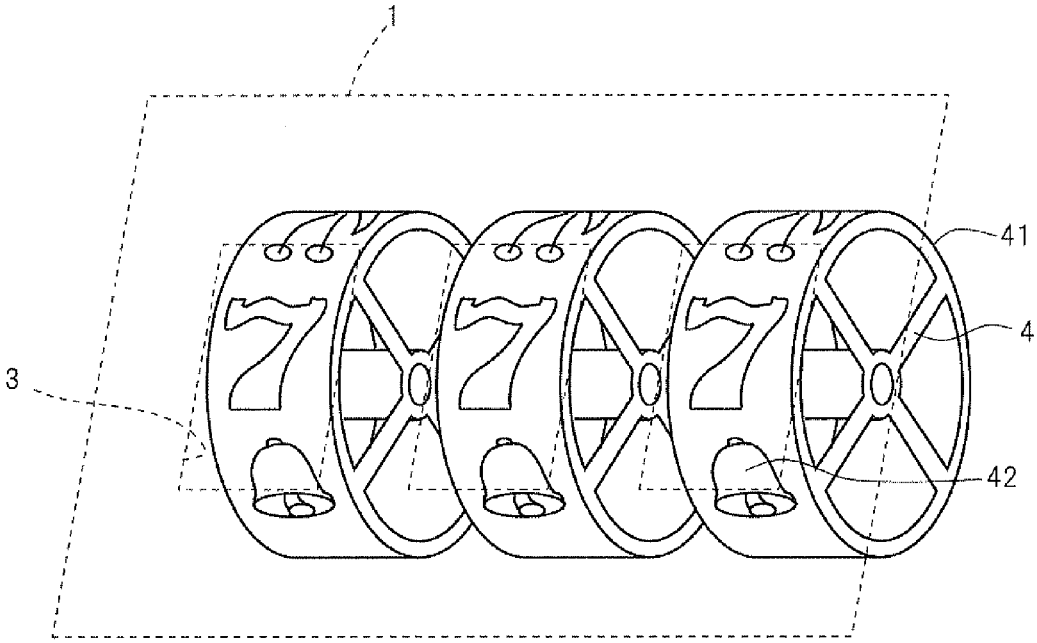
FIG. 2 is a schematic diagram of reels and the immediate vicinity thereof, which are installed in the slot machine shown in FIG. 1.
Figure 3C:
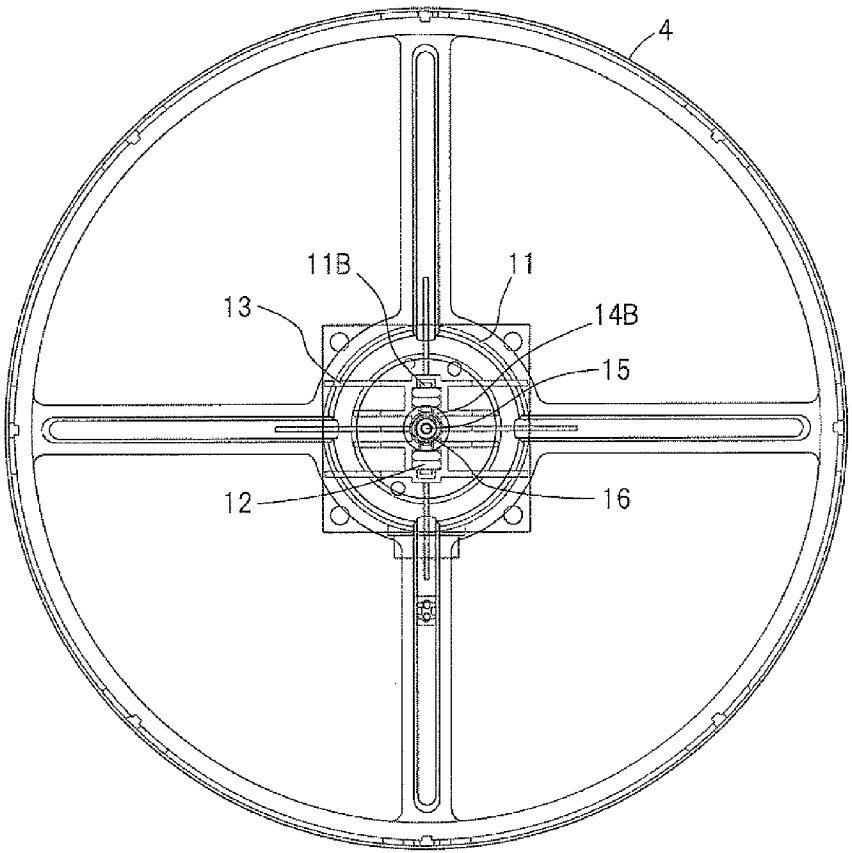
FIG. 3C is a front view of the same reel assembly.
Figure 3B:
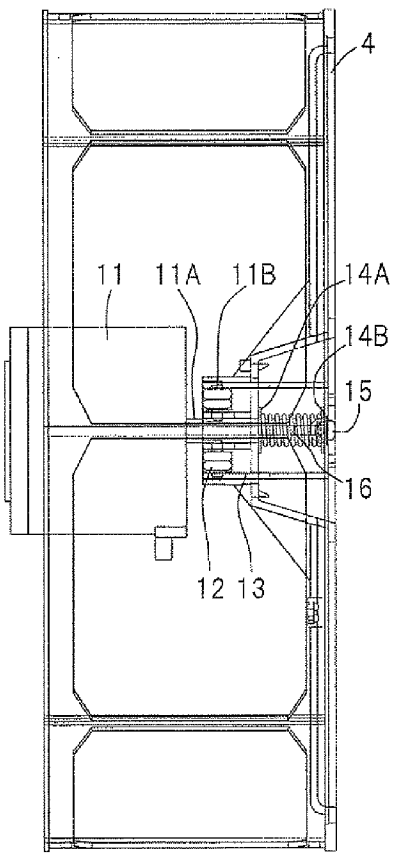
FIG. 3B is a side view of a reel assembly according to the present invention.
Figure 3A:
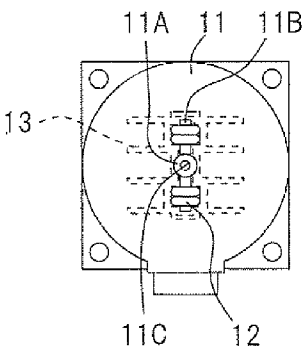
FIG. 3A is a front view of a stepping motor according to the present invention.

Three or more reels 4 are shaped in the same drum and installed inside the cabinet 1 rotatably around the center axes thereof, which are positioned coaxially and horizontally, as shown in FIG. 2. A portion of each circumferential surface of the reel 4 is visible through a window 3 provided in the front surface of the cabinet 1. Each of the reels 4 is preferably included in a stepper reel assembly. In other words, the rotation angle and speed of the reel 4 can be controlled by a stepping motor (details will be described below). A predetermined line of symbols 42 are displayed on each circumferential surface 41 of the reels 4. Different symbols 42 appear in the windows 3, depending on the rotation angles of the reels 4.

A player inserts coins, medals, bills, or a ticket into the coin inlet 7. The inserted coins, medals, and bills are counted, or the number of credits is read from the inserted ticket inside the cabinet 1, and then, the total amount of the coins and the like are used to place bets in games as credits of the player.

The player operates the slot machine by using the buttons 5 and 6 as follows. First, by using one or more of the operation buttons 5, the player selects one or more winning lines of the symbol matrix visible in the windows 3, and places bets on the selected winning lines. Next, the player pushes the spin button 6, and then, the reels 4 start spinning and the symbols 42 move in the vertical direction in the windows 3. Here, the typical slot machine determines the stop positions of the reels 4 at random at the time when the player pushes the spin button 6. After that, the player pushes the operation buttons 5, and then the symbols 42 will stop reel by reel. When the selected winning line of the stopped symbol matrix includes a winning combination, the player will win an award or a bonus depending on the bet and the probability of the winning combination. The player will push a payout button, and coins equivalent to the player's credit will be discharged out of the coin outlet 8 from a coin hopper installed in the cabinet 1 and stored in the coin receiver 9. Alternatively, a ticket will come out of a ticket outlet (not shown in FIG. 1). On the ticket, the amount of the player's credits will be printed in numerals and a bar code. At the time of the payout, the player can also use the operation buttons 5 to select either coins or a ticket.

Each of the reels 4 is included in a reel assembly 10 of Embodiment 1 according to the present invention (see FIGS. 3A, 3B, 3C, 4A, and 4B). The reel assembly 10 preferably comprises a stepping motor 11, a first elastic member 12, two washers 14A, 14B, a screw 15, and a second elastic member 16, in addition to the reel 4.

The stepping motor 11 is mounted on a supporting member that is fixed inside the cabinet 1 (not shown in the figures). The shaft 11A of the stepping motor 11 has two branches 11B perpendicular to the shaft 11A fixed at the base thereof, and a female thread 11C formed at the tip thereof. The first elastic member 12 is preferably an O-ring made of an elastomer. Two of the first elastic members 12 are positioned around each of the branches 11B.

The reel 4 is preferably a plastic drum, the whole of which is integrally molded, or parts of which are separately molded and combined into one. Here, the symbols 42 shown in FIG. 2 are preferably printed on a strip of paper, which will be wound around the reel 4 shown in FIGS. 3B, 3C, 4A, and 4B to constitute the circumferential surface 41 shown in FIG. 2. The shaft 11A of the stepping motor 11 is inserted in a hole 13A opened at the center portion 13 of the reel 4 along the center axis thereof (see FIG. 4B). A hollow 13B is formed at the surface of the center portion 13 opposed to the front surface of the stepping motor 11. The first elastic members 12 fit in the hollow 13B (see FIGS. 3A, 3B, 3C, and 4B). The two branches 11B, the first elastic members 12, and the center portion 13 thus constitute a joint between the shaft 11A and the reel 4. At the joint, the first elastic members 12 are contact with the center portion 13 of the reel 4 and allowed to deform in the axial and circumferential directions of the shaft 11A.

The shaft 11A passes through the hole 13A of the center portion 13, the first washer 14A, the second elastic member 16, and the second washer 14B in that order. The second elastic member 16 is preferably a coil spring, or alternatively may be a sleeve made of an elastomer. The second elastic member 16 is preferably concentric with the shaft 11A, and deformable between the washers 14A and 14B in the axial direction of the shaft 11A. The screw 15 is coupled to the female thread 11C at the tip of the shaft 11A. The screw 15 then presses the center portion 13 of the reel 4 in the axial direction through elastic deformation of the second elastic member 16, and thereby secures the reel 4 on the shaft 11A. In this manner, the female thread 11C of the shaft 11A, the two washers 14A, 14B, the screw 15, and the second elastic member 16 constitute a fastening member between the shaft 11A and the reel 4. Furthermore, the elastic force of the second elastic member 16 compresses the first elastic members 12 in the axial direction between the center portion 13 and the branches 11B.

The stepping motor 11 rotates the reel 4 under the control executed by a microcomputer installed inside the cabinet 1 (not shown in the figures). This allows the reel 4 to spin at various rates, in the reverse direction, and with a high degree of precision. In particular, the stepping motor 11 exerts torque on the reel 4 through circumferential compression of the first elastic members 12. In this case, the circumferential deformation of the first elastic members 12 absorbs circumferential vibrations of the reel 4 quickly and reliably at a stop position. In addition, the axial deformation of the second elastic member 16 absorbs axial vibrations of the reel 4 quickly and reliably at a stop position. Here, the two types of the elastic members 12 and 16 are combined in the simple structure described above. Therefore, the reel assembly has a higher degree of maintainability and reliability. As a result, the reel assembly facilitates the enhancement of the visual effects of the slot machine by using the quick and reliable spinning motions of the reel 4.

Figure 11A:
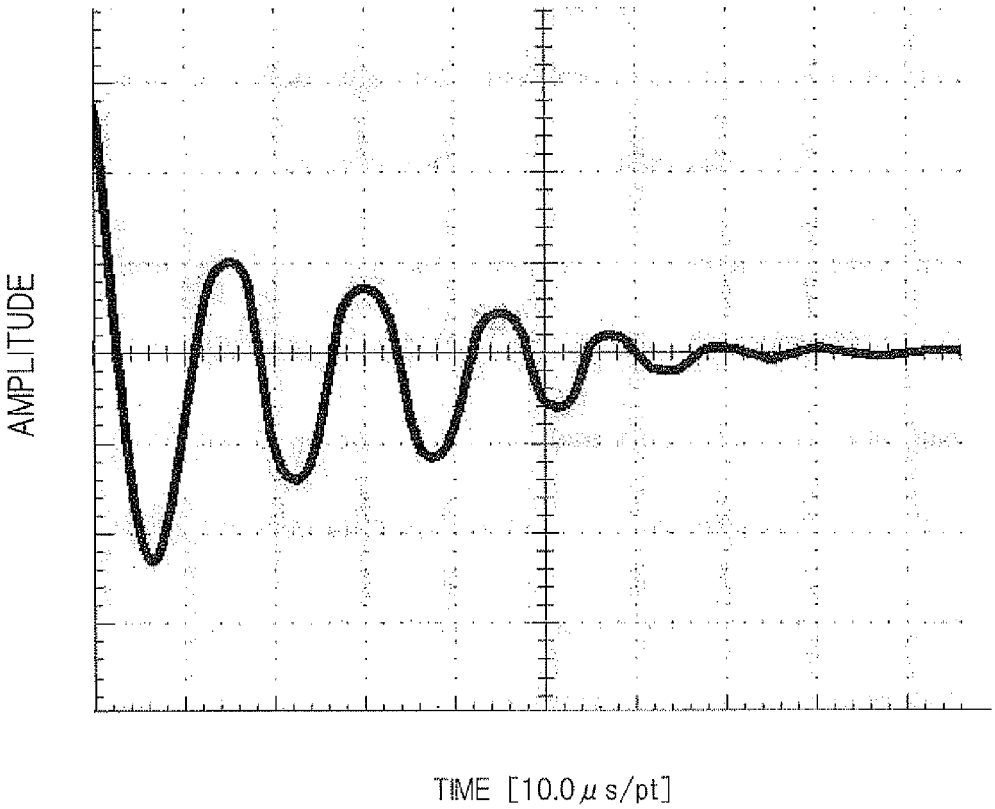
FIG. 11A is a graph of changes in amplitude of circumferential vibration of a reel in a prior-art reel assembly.
Figure 11B:
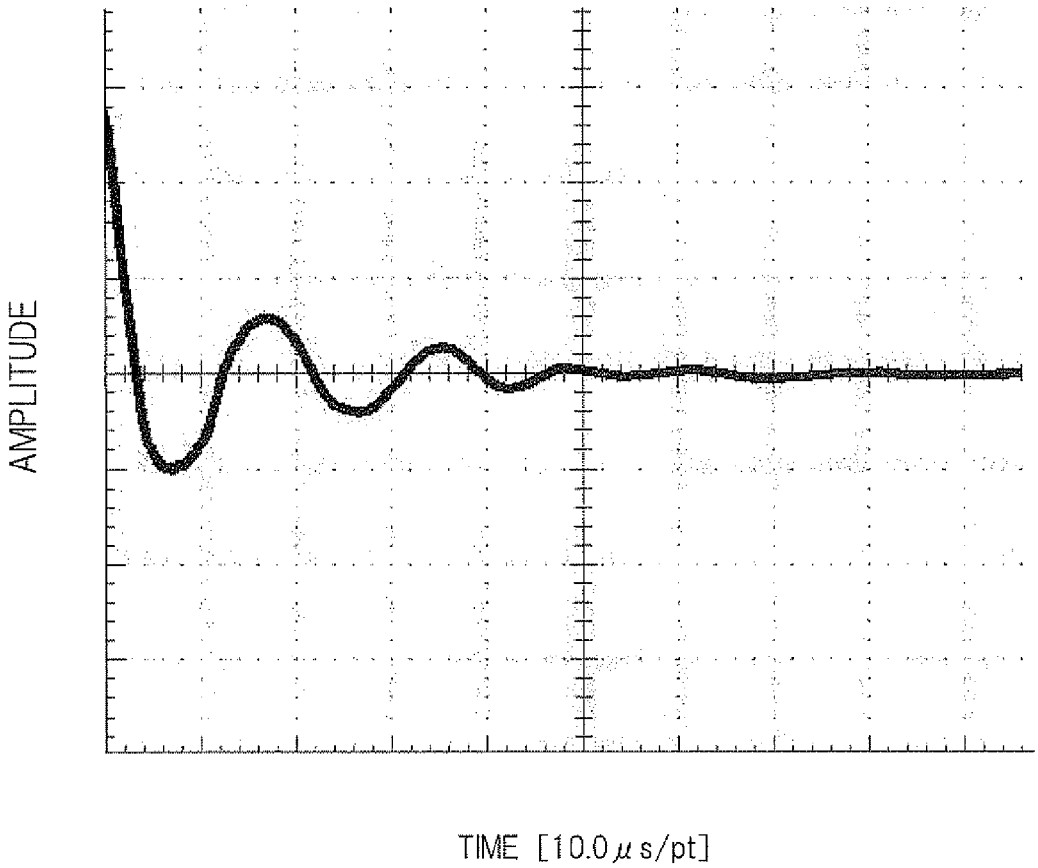
FIG. 11B is a graph of changes in amplitude of circumferential vibration of a reel in a reel assembly of the present invention.

The circumferential vibrations of the reel 4 of the reel assembly 10 without and with the second elastic member 16 are shown in graph form in FIGS. 11A and 11B, respectively. Each of the graphs shows a typical change in amplitude of circumferential vibration of the reel 4 immediately after the stepping motor 11 stops the reel 4. As is clear from the comparison between FIGS. 11A and 11B, the amplitude of the circumferential vibration is diminished faster when the second elastic member 16 is installed in the reel assembly 10.

Since the first elastic members 12 are made of elastomer, the circumferential elasticity of the first elastic member 12 varies with the axial compressions caused by the elastic force of the second elastic member 16. Here, the elastic force of the second elastic member 16 can be designed with flexibility by the size and material thereof. Accordingly, the circumferential elasticity of the first elastic member 12 is easy to optimize for absorbing the circumferential vibrations of a reel 4 of whatever size and weight. In particular, the second elastic member 16 is a coil spring, and thus, the axial length of the second elastic member 16 can be easily designed within wider ranges. This flexibility can facilitate the reduction of the various vibration modes of the reel 4 within wider ranges in elasticity of the first elastic members 12. The flexibility further enhances the reliability of the reel assembly 10, and therefore allows the reel assembly 10 to maintain a higher degree of reliability regardless of frequent model changes of the slot machine.

Here, the first washer 14A is positioned between the second elastic member 16 and the surface of the center portion 13, and reduces the friction between the second elastic member 16 and the center portion 13 within an appropriate range. If necessary to adjust the friction, a protrusion and a depression may be formed on the surfaces of the first washer 14A and the center portion 13 that are in contact with each other, respectively, or vice versa. The first washer 14A thereby prevents the second elastic member 16 from excessively delaying the spinning of the reel 4.

The reel assembly 10 may further comprise a lubricating layer positioned on one of the radially opposed surfaces of the reel 4 and the shaft 11A or between the surfaces (not shown in the figures). More specifically, the lubricating layer is positioned on either or both of the outer surface of the shaft 11A and the inner surface of the hole 13A, or between the surfaces (cf. FIG. 4B). Here, the lubricating layer is preferably made of a lubricant, or alternatively may be a low-friction material integrated into one of the shaft 11A and the center portion 13 of the reel 4, or formed separately from both of them. The lubricating layer reduces the friction between the shaft 11A and the reel 4, and thereby maintains the friction at a substantially constant level regardless of dimensional and assembly deviation in the components, operational and environmental conditions, time, etc. This facilitates the design of the axial length of the second elastic member 16, and thus enhances the maintainability and reliability of the reel assembly 10.

Figure 4A:
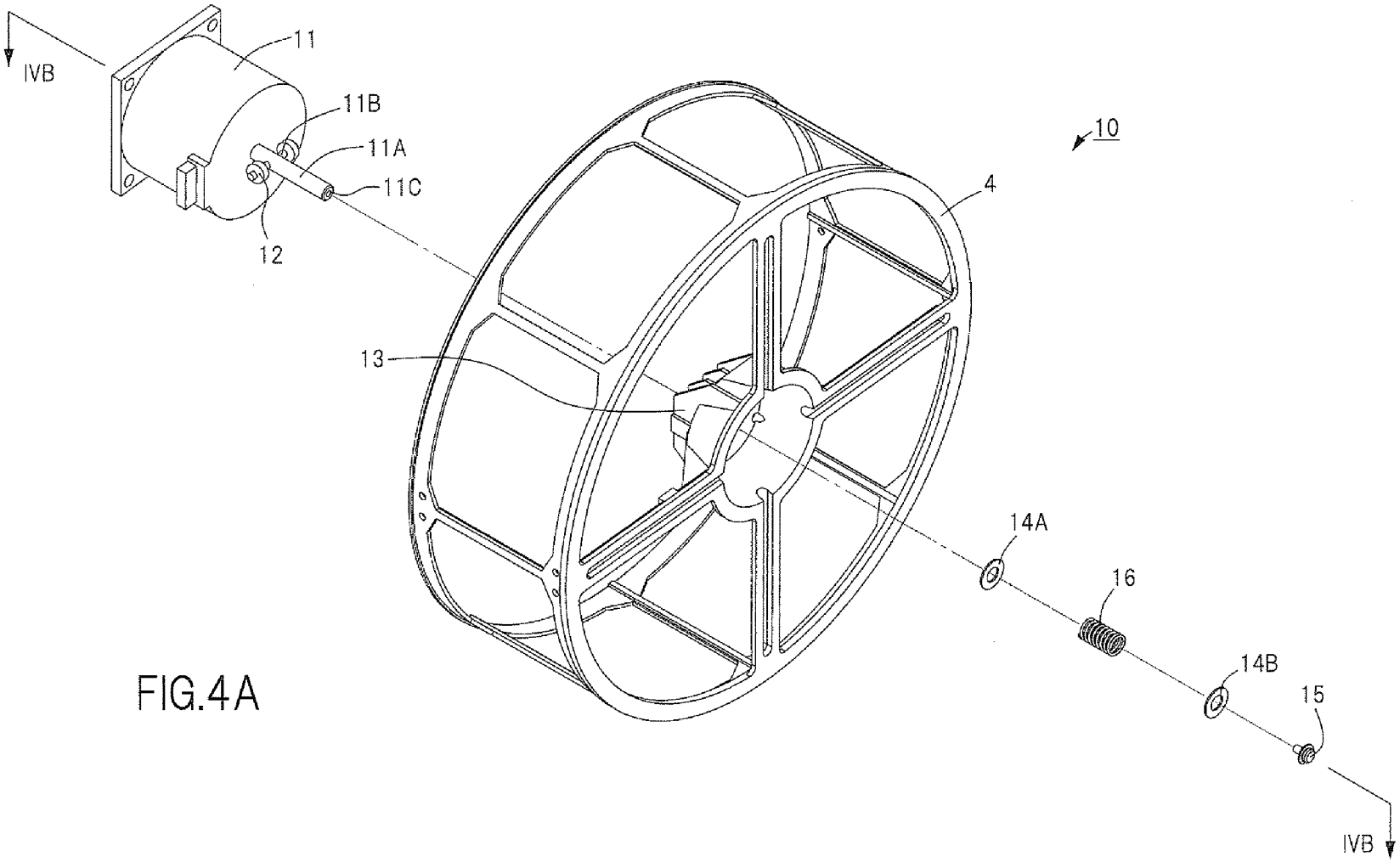
FIG. 4A is an exploded perspective view of a reel assembly according to Embodiment 1 of the present invention.
Figure 4B:
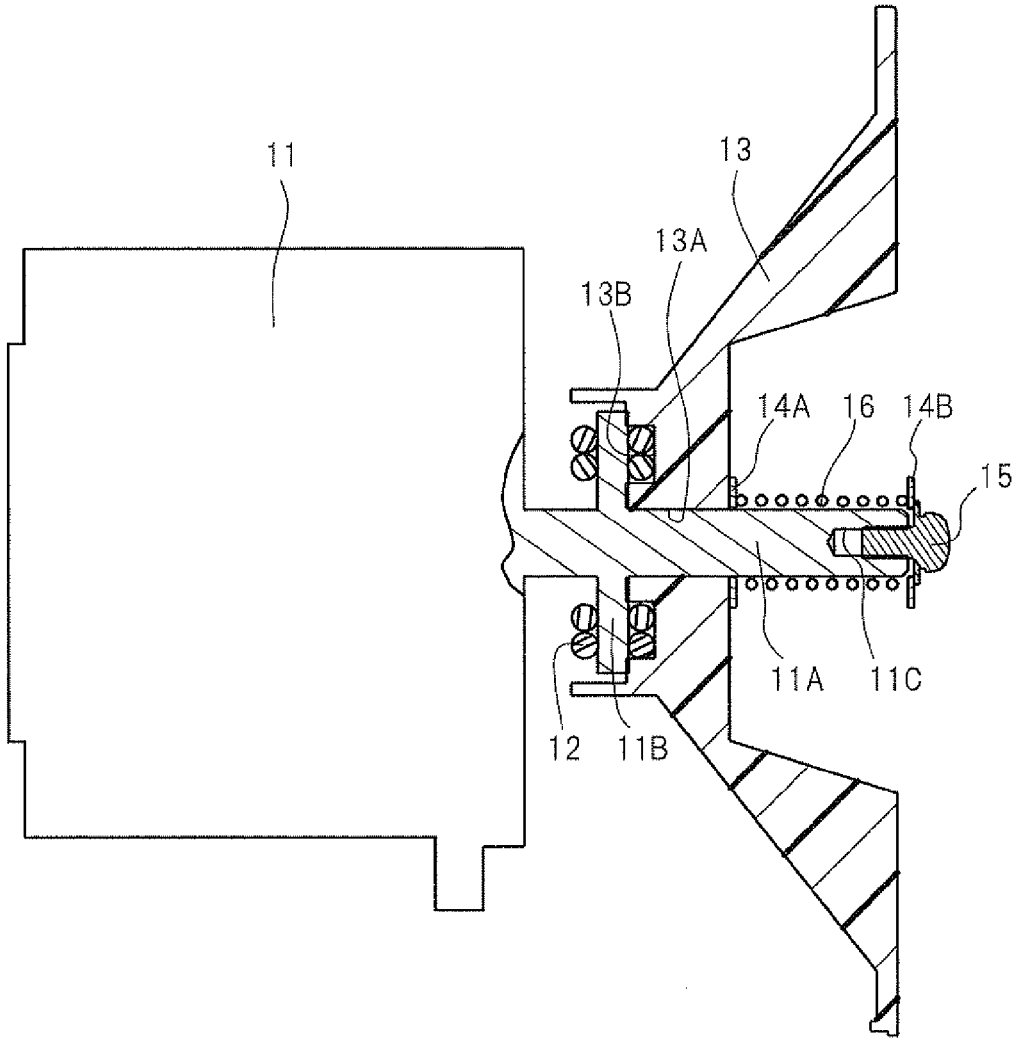
FIG. 4B is a fragmentary cross sectional view taken along lines IVB-IVB of FIG. 4A.
Figure 5A:
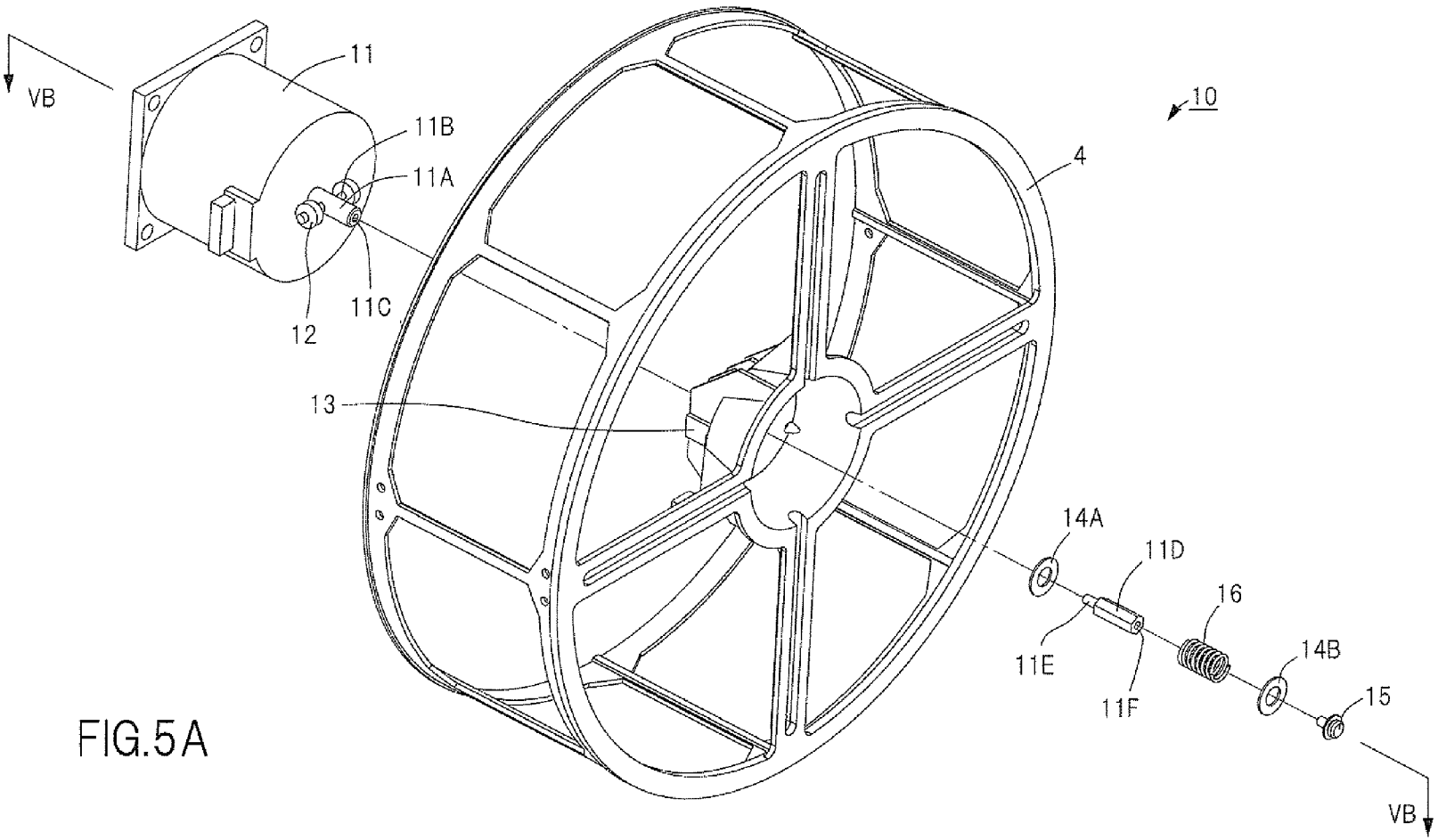
FIG. 5A is an exploded perspective view of another reel assembly according to Embodiment 1 of the present invention.
Figure 5B:
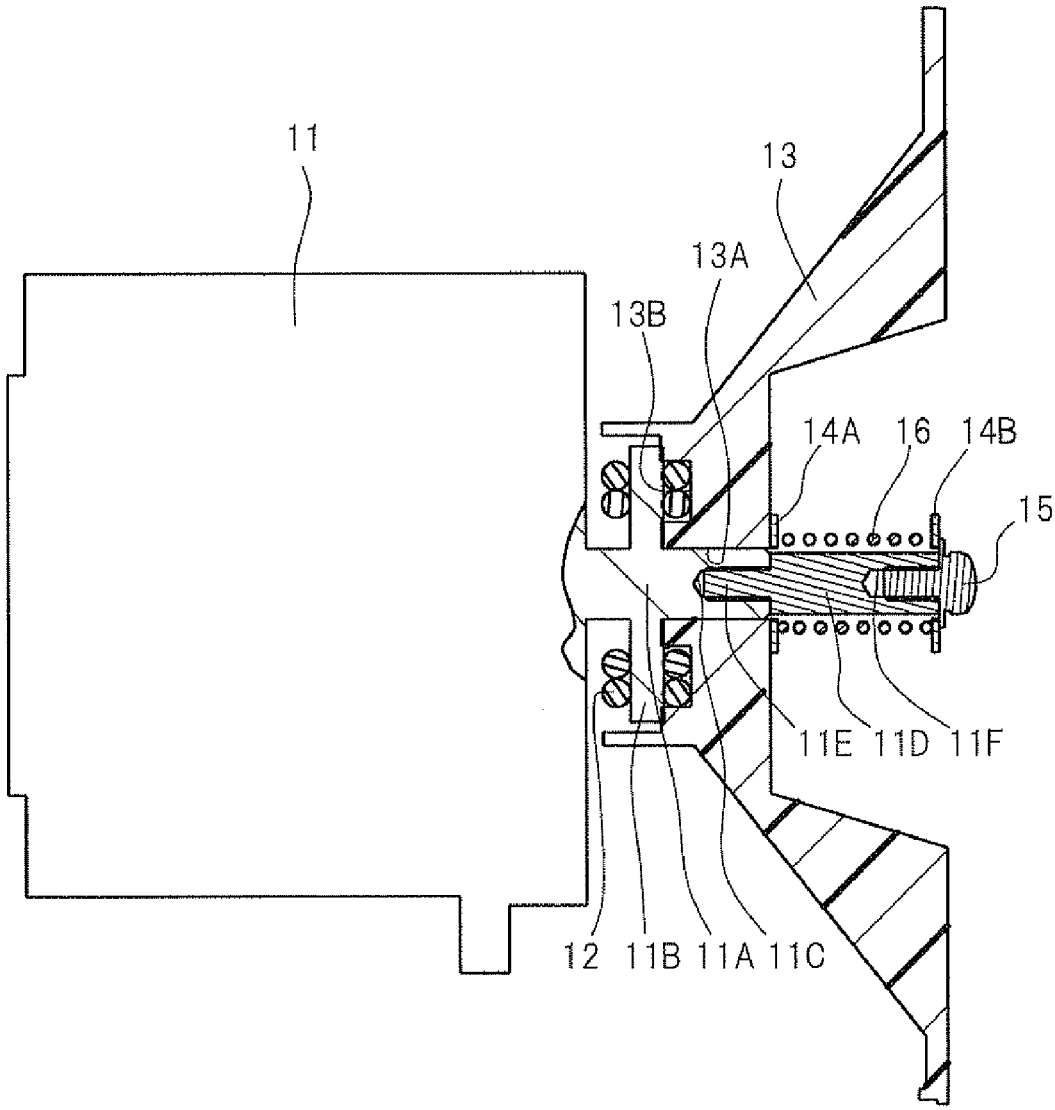
FIG. 5B is a fragmentary cross sectional view taken along lines VB-VB of FIG. 5A.

In FIGS. 4A and 4B, the tip of the shaft 11A is integrated with the base thereof including the branches 11B, and directly coupled to the fastening member 14A, 14B, 15, and 16. Alternatively, the tip of the shaft 11A may be separable from the base thereof as shown in FIGS. 5A and 5B. Note that, in FIGS. 5A and 5B, components similar to those shown in FIGS. 4A and 4B are marked with the same reference numbers as those used to mark the similar components shown in FIGS. 4A and 4B. A spacer 11D is a rod including a male thread 11E at one end and a female thread 11F at the other end. The male thread 11E is coupled to the female thread 11C of the shaft 11A. The spacer 11D is positioned in the first washer 14A, the second elastic member 16, and the second washer 14B arranged in that order. The screw 15 is coupled to the female thread 11E of the spacer 11D. The screw 15 then presses the center portion 13 of the reel 4 in the axial direction through elastic deformation of the second elastic member 16. In this manner, the spacer 11D, the two washers 14A, 14B, the screw 15, and the second elastic member 16 constitute a fastening member between the shaft 11A and the reel 4. The size of the spacer 11D can be designed with more flexibility and higher precision than the size of the shaft 11A. Accordingly, the spacer 11D can facilitate the design of the size of the second elastic member 16 and the design of the axial and circumferential compression of the first elastic members 12.

Embodiment 2

Like the reel assembly of Embodiment 1, a reel assembly according to a second embodiment of the present invention is preferably installed in a stepper-reel slot machine. The components of Embodiment 2 are similar to those of Embodiment 1 except for a fastening member of the reel assembly (see FIGS. 6A and 6B). A description of the similar components can be found above in the description of Embodiment 1.

As is clear from a comparison between FIGS. 4A, 4B and FIGS. 6A, 6B, the reel assembly 20 of Embodiment 2 differs the reel assembly 10 of Embodiment 1 in the structure of the shaft 21C of the stepping motor 11 and a fastening member: two washers 14A, 14B, a second elastic member 16, and a nut 17. Note that, in FIGS. 6A and 6B, components similar to those shown in FIGS. 4A and 4B are marked with the same reference numbers as those used to mark the similar components shown in FIGS. 4A and 4B.

Like the shaft 11A of the stepping motor 11 of Embodiment 1, the shaft 21A of the stepping motor 11 of Embodiment 2 has two branches 21B perpendicular to the shaft 21A fixed at the base thereof. Two of the first elastic members 12 (preferably, O-rings made of elastomer) are positioned around each of the branches 21B. The first elastic members 12 fit in the hollow 13B of the center portion 13 of the reel 4.

In contrast to the female thread 11C formed at the tip of the shaft 11A of Embodiment 1, a male thread 21C is formed at the tip of the shaft 21A of Embodiment 2. The male thread 21C passes through the hole 13A of the center portion 13, the first washer 14A, the second elastic member 16, and the second washer 14B in that order. The nut 17 is coupled to the tip of the male thread 21C. The nut 17 then presses the center portion 13 in the axial direction through elastic deformation of the second elastic member 16, and thereby secures the reel 4 on the shaft 21A. In this manner, the male thread 21C, the two washers 14A, 14B, the second elastic member 16, and the nut 17 constitute a fastening member between the shaft 21A and the reel 4. Furthermore, the elastic force of the second elastic member 16 compresses the first elastic members 12 in the axial direction between the center portion 13 and the branches 21B.

The axial length of the second elastic member 16 of Embodiment 1 is fixed by the axial length of the tip of the shaft 11A (cf. FIG. 4B) or the spacer 11D (cf. FIG. 5B). In contrast to that, the second elastic member 16 of Embodiment 2 is adjustable in axial length within wider ranges by changing the axial position of the nut 17 along the male thread 21C (cf. FIG. 6B). Accordingly, the default elastic force of the second elastic member 16 is easy to adjust with more flexibility and higher precision even after manufacture of the reel assembly 20. The adjustment can compensate the fluctuations of the elasticity of the first elastic members 12 and the vibration modes of the reel 4 caused by dimensional and assembly deviation in the components, operational and environmental conditions, time, etc. This further enhances the reliability and maintainability of the reel assembly 20. Therefore, the reel assembly 20 can maintain a higher degree of reliability, regardless of frequent model changes of the slot machine.

Figure 6A:
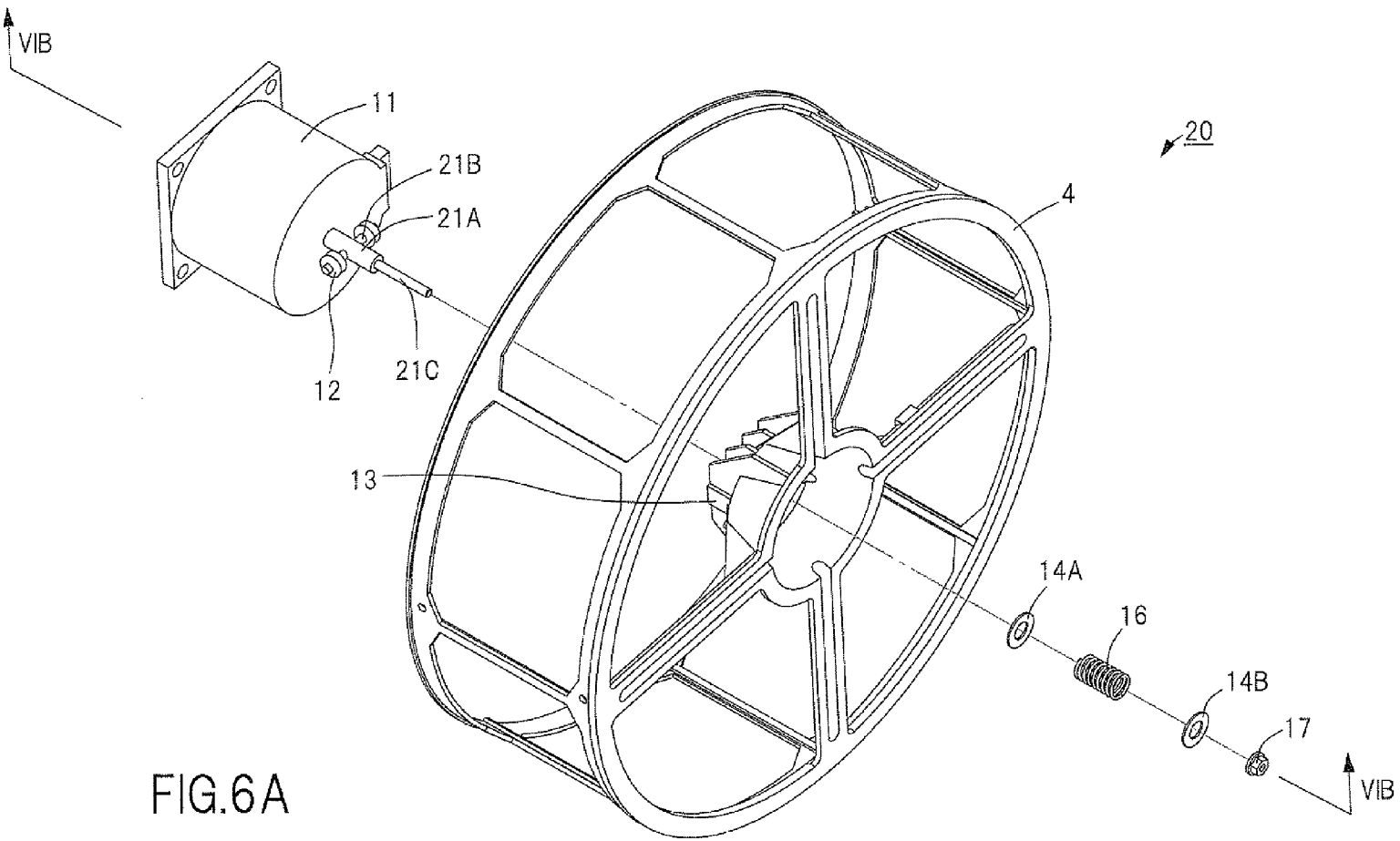
FIG. 6A is an exploded perspective view of a reel assembly according to Embodiment 2 of the present invention.
Figure 6B:
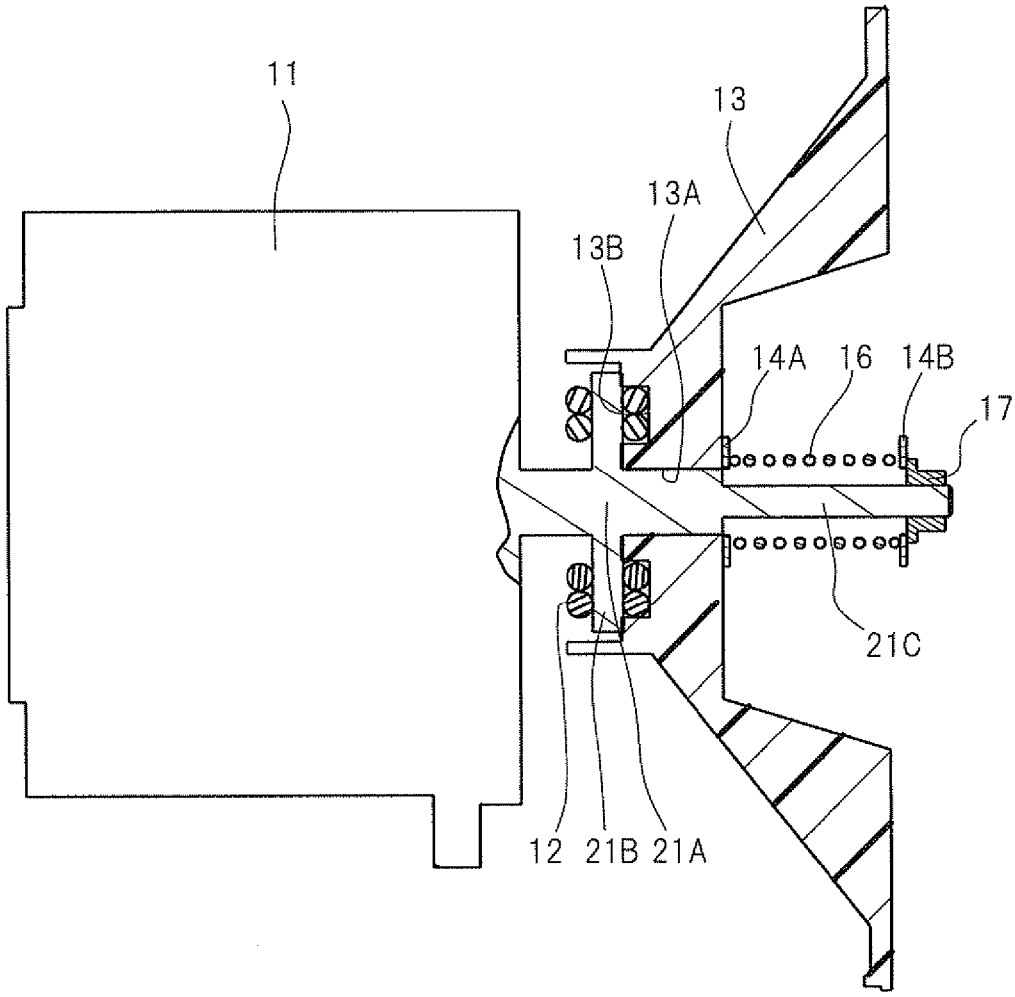
FIG. 6B is a fragmentary cross sectional view taken along lines VIB-VIB of FIG. 6A.
Figure 7A:
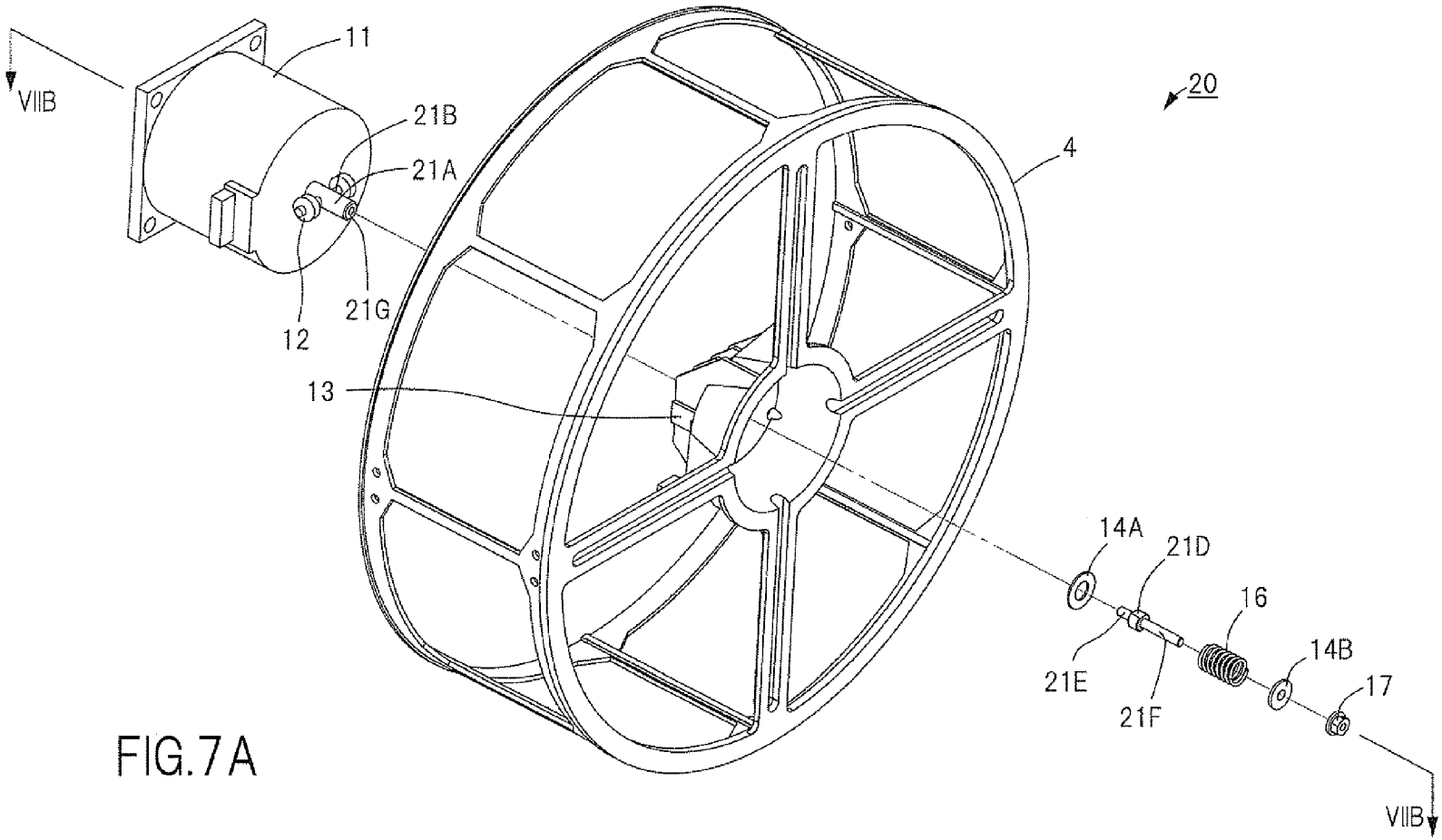
FIG. 7A is an exploded perspective view of another reel assembly according to Embodiment 2 of the present invention.
Figure 7B:
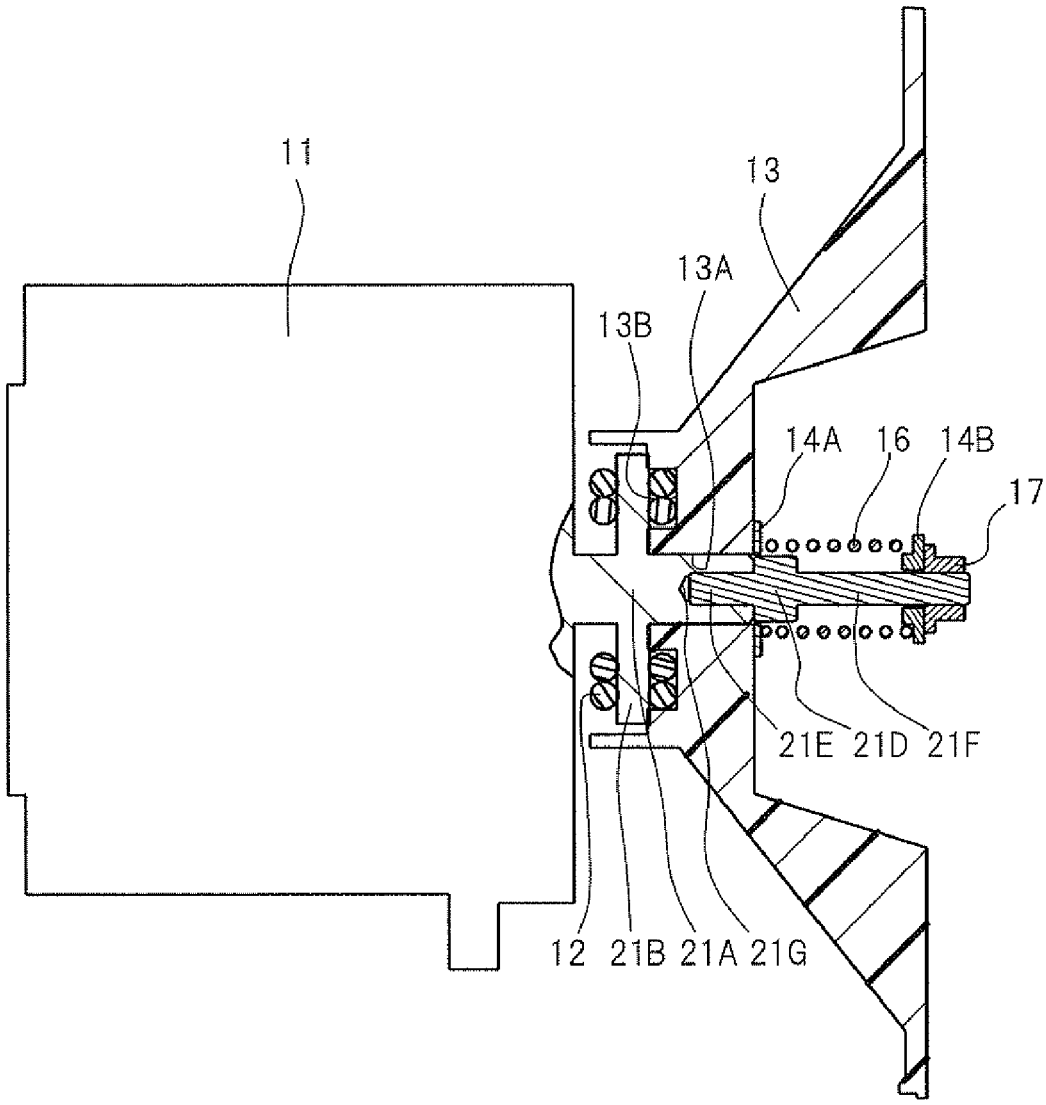
FIG. 7B is a fragmentary cross sectional view taken along lines VIIB-VIIB of FIG. 7A.

In FIGS. 6A and 6B, the male thread 21C of the shaft 21A is integrated with the base thereof including the branches 21B, and directly coupled to the fastening member 14A, 14B, 16, and 17. Alternatively, the male thread of the shaft 21A may be separable from the base thereof as shown in FIGS. 7A and 7B. Note that, in FIGS. 7A and 7B, components similar to those shown in FIGS. 6A and 6B are marked with the same reference numbers as those used to mark the similar components shown in FIGS. 6A and 6B. A spacer 21D is a rod including a first male thread 21E at one end and a second male thread 21F at the other end. The first male thread 21l is coupled to a female thread 21G formed at the tip of the shaft 21A. The second male thread 21F is positioned in the first washer 14A, the second elastic member 16, and the second washer 14B arranged in the order thereof. The nut 17 is coupled to the second male thread 21F, and then presses the center portion 13 of the reel 4 in the axial direction through elastic deformation of the second elastic member 16. In this manner, the spacer 21D, the two washers 14A, 14B, the second elastic member 16, and the nut 17 constitute a fastening member between the shaft 21A and the reel 4. The size of the spacer 21D can be designed with more flexibility and higher precision than the size of the shaft 21A. Accordingly, the spacer 21D can facilitate the design of the size of the second elastic member 16 and the design of the axial and circumferential compression of the first elastic members 12.

Embodiment 3

Figure 8A:
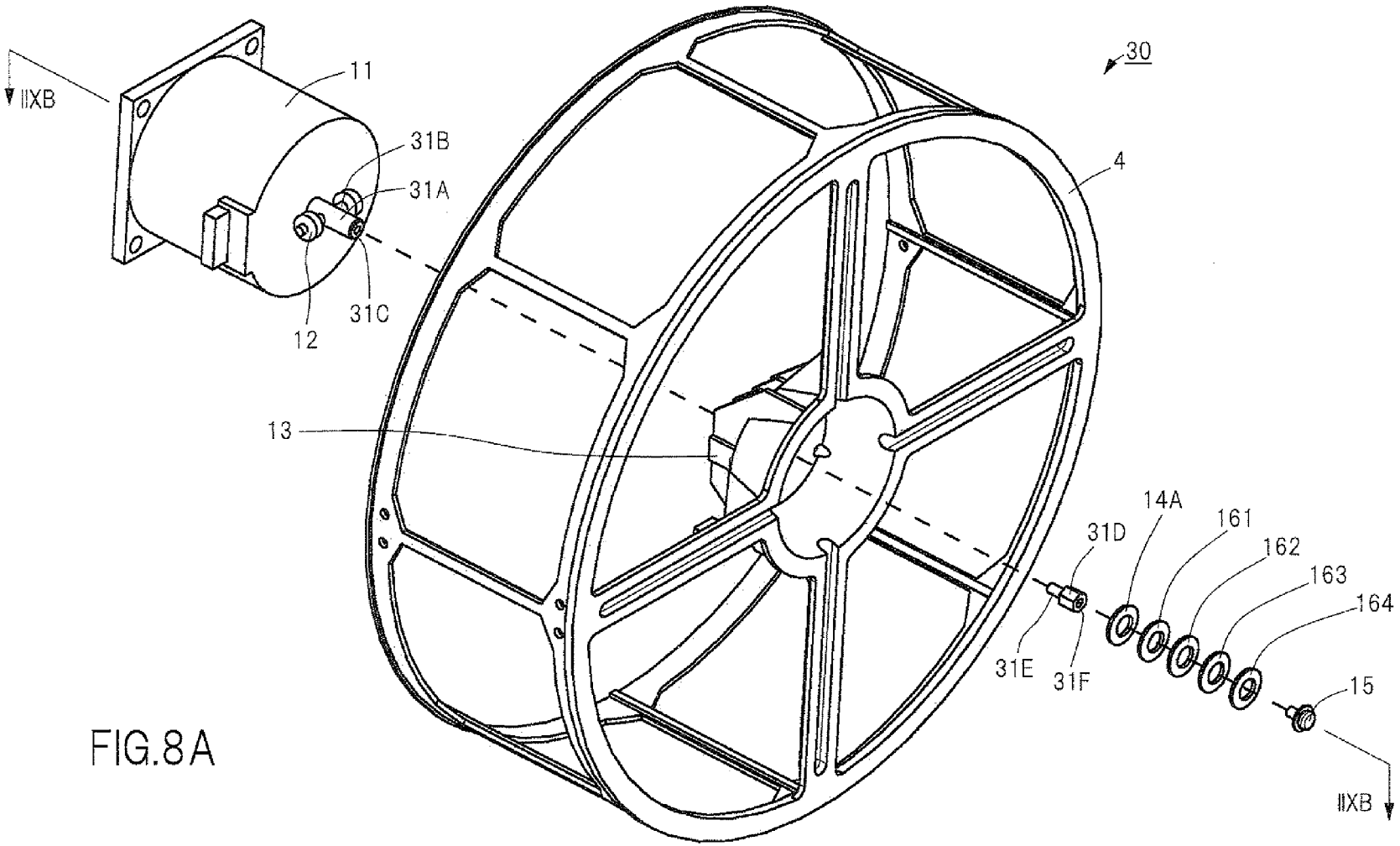
FIG. 8A is an exploded perspective view of a reel assembly according to Embodiment 3 of the present invention.
Figure 8B:
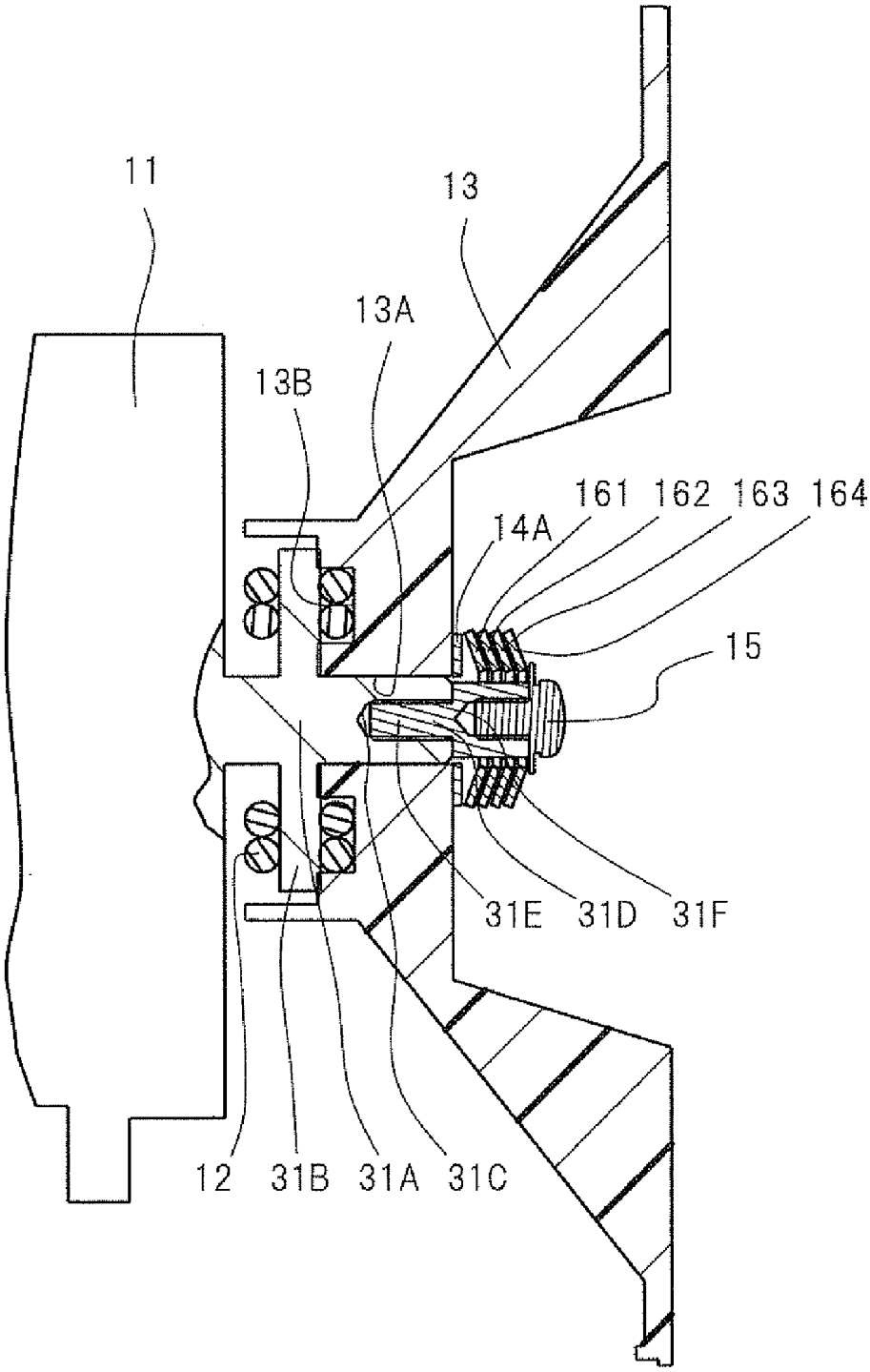
FIG. 8B is a fragmentary cross sectional view taken along lines IIXB-IIXB of FIG. 8A.

A coil spring 16 is used as the second elastic member in the reel assemblies of the above embodiments. The coil spring 16 may be replaced with one or more conical spring washers. In FIGS. 8A and 8B, a reel assembly 30 according to a third embodiment of the present invention uses a series of four conical spring washers 161, 162, 163, and 164 as a second elastic member. Note that, in FIGS. 8A and 8B, components similar to those shown in FIGS. 4A and 4B are marked with the same reference numbers as those used to mark the similar components shown in FIGS. 4A and 4B.

Like the shaft 11A of the stepping motor 11 of Embodiment 1, the shaft 31A of the stepping motor 11 of Embodiment 3 has two branches 31B perpendicular to the shaft 31A fixed at the base thereof, and a female thread 31C at the tip thereof. Two of the first elastic members 12 (preferably, O-rings made of elastomer) are positioned around each of the branches 31B. The first elastic members 12 fit in the hollow 13B of the center portion 13 of the reel 4.

A spacer 31D is a short rod including a male thread 31E at one end and a female thread 31F at the other end. The male thread 31L is coupled to the female thread 31C of the shaft 31A. The spacer 31D is positioned in the first washer 14A and the series of the four conical spring washers 161, 162, 163, 164 arranged in that order. Preferably, the convex side of each of the conical spring washers 161, 162, 163, and 164 faces the concave side of the next adjacent one thereof Alternatively, the convex sides of each adjacent pair of the conical spring washers 161-162 and 163-164 may face each other. The screw 15 is coupled to the female thread 31E of the spacer 31D. The screw 15 then presses the center portion 13 of the reel 4 in the axial direction through elastic deformation of the conical spring washers 161, 162, 163, and 164. In this manner, the spacer 31D, the washer 14A, the screw 15, and the conical spring washers 161, 162, 163, 164 constitute a fastening member between the shaft 31A and the reel 4.

Conical spring washers have an advantage over coil springs in volume, in particular, axial length. Accordingly, the spacer 31D shown in FIGS. 8A and 8B can be sufficiently shorter than the spacer 11D shown in FIGS. 4A and 4B, while maintaining the axial elastic forces of the second elastic members to be at a similar level. This avoids the tip of the spacer 31D and the head of the screw 15 from jutting out of the side surface of the reel 4. Therefore, the reel assembly 30 of Embodiment 3 allows another reel assembly or other components of the slot machine to be closer to the side surface of the reel 4. This can provide a layout design of the slot machine with more flexibility and reliability.

Embodiment 4

Like the reel assembly of Embodiment 1, a reel assembly according to a fourth embodiment of the present invention is preferably installed in a stepper-reel slot machine. The components of Embodiment 4 are similar to those of Embodiment 1 except for a second elastic member of the reel assembly (see FIGS. 9A and 9B). A description of the similar components can be found above in the description of Embodiment 1.

As is clear from a comparison between FIGS. 4A, 4B and FIGS. 9A, 9B, the reel assembly 40 of Embodiment 4 comprises two coil springs 16A and 16B in contrast to the reel assembly 10 of Embodiment 1 having the single coil spring 16 served as the second elastic member. Note that, in FIGS. 9A and 9B, components similar to those shown in FIGS. 4A and 4B are marked with the same reference numbers as those used to mark the similar components shown in FIGS. 4A and 4B.

Figure 10A:
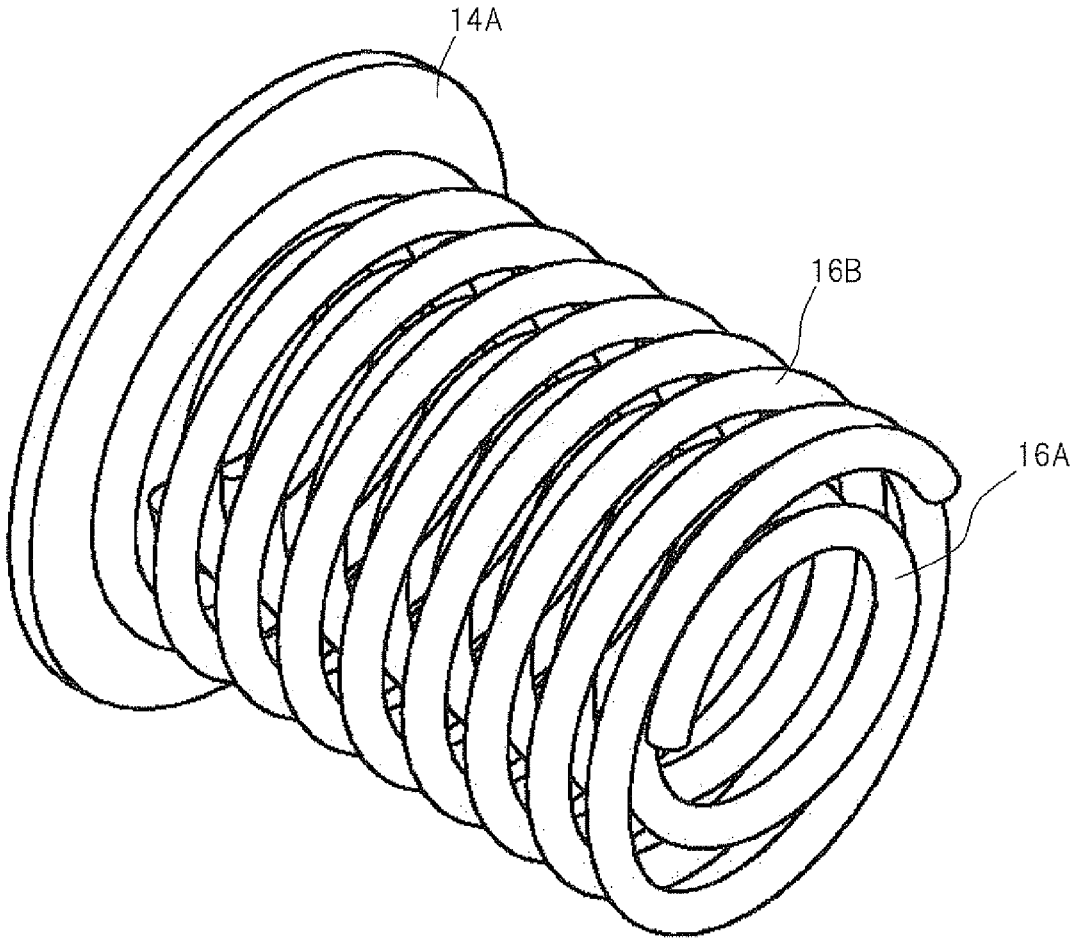
FIG. 10A is an perspective view of a pair of two coil springs included in the reel assembly shown in FIGS. 9A and 9B.
Figure 10B:
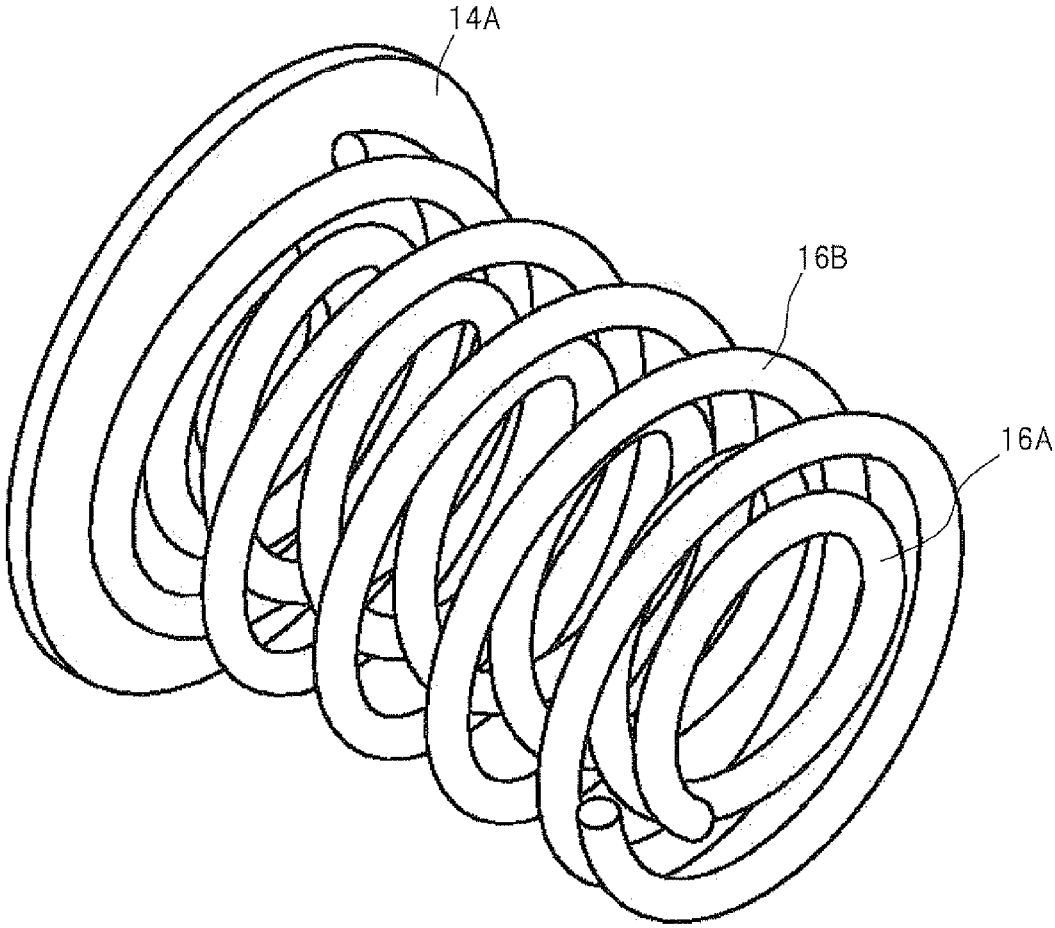
FIG. 10B is an perspective view of another pair of two coil springs included in the reel assembly shown in FIGS. 9A and 9B.

The two coil springs 16A and 16B are formed in different diameters, arranged at concentric positions with the shaft 11A of the stepping motor 11, and wound around the tip of the shaft 11A in opposite circumferential directions (cf. FIGS. 10A and 10B). Here, the two coil springs 16A and 16B may have the same pitch (cf. FIG. 10A) or different pitches (cf. FIG. 10B). The two coil springs 16A and 16B are allowed to deform between the washers 14A and 14B in the axial direction of the shaft 11A. The screw 15 is coupled to the female thread 11C formed at the tip of the shaft 11A. The screw 15 then presses the center portion 13 of the reel 4 in the axial direction through elastic deformation of the two coil springs 16A and 16B, and thereby secures the reel 4 on the shaft 11A. In this manner, the female thread 11C of the shaft 11A, the two washers 14A, 14B, the screw 15, and the two coil springs 16A and 16B constitute a fastening member between the shaft 11A and the reel 4. Furthermore, the elastic forces of the two coil springs 16A and 16B compress the first elastic members 12 in the axial direction between the center portion 13 and the branches 11B.

By being wound around the tip of the shaft 11A in opposite circumferential directions, the two coil springs 16A and 16B exert torque on the reel in opposite directions by means of the friction between the two coil springs 16A, 16B, the first washer 14A, and the surface of the center portion 13, and the respective elasticity in torsion. The circumferential deformation of the two coil springs 16A and 16B complement each other in the quick and reliable reduction of circumferential vibrations of the reel 4 at a stop position. Here, if the two coil springs 16A and 16B have a sufficiently high level of ability to absorb the circumferential vibrations, the first elastic members 12 may be eliminated and the shaft 11A may be rigidly fixed at the center portion 13 of the reel 4.

The simple structure of the combination of the two coil springs 16A and 16B can absorb axial and circumferential vibrations of the reel 4 quickly and reliably at a stop position. In particular, the axial elastic forces of the two coil springs 16A and 16B can be designed with more flexibility by selecting the ratio in diameter therebetween as well as each size and material thereof. Accordingly, the elasticity of the two coil springs is easy to optimize for absorbing both the axial and circumferential vibrations of a reel 4 of whatever size and weight. Thus, the reel assembly 40 has higher degrees of maintainability and reliability, regardless of frequent model changes of the slot machine. Therefore, the reel assembly 40 can facilitate the enhancement of the visual effects of the slot machine by using the quick and reliable spinning motions of the reel 4.

Figure 9A:
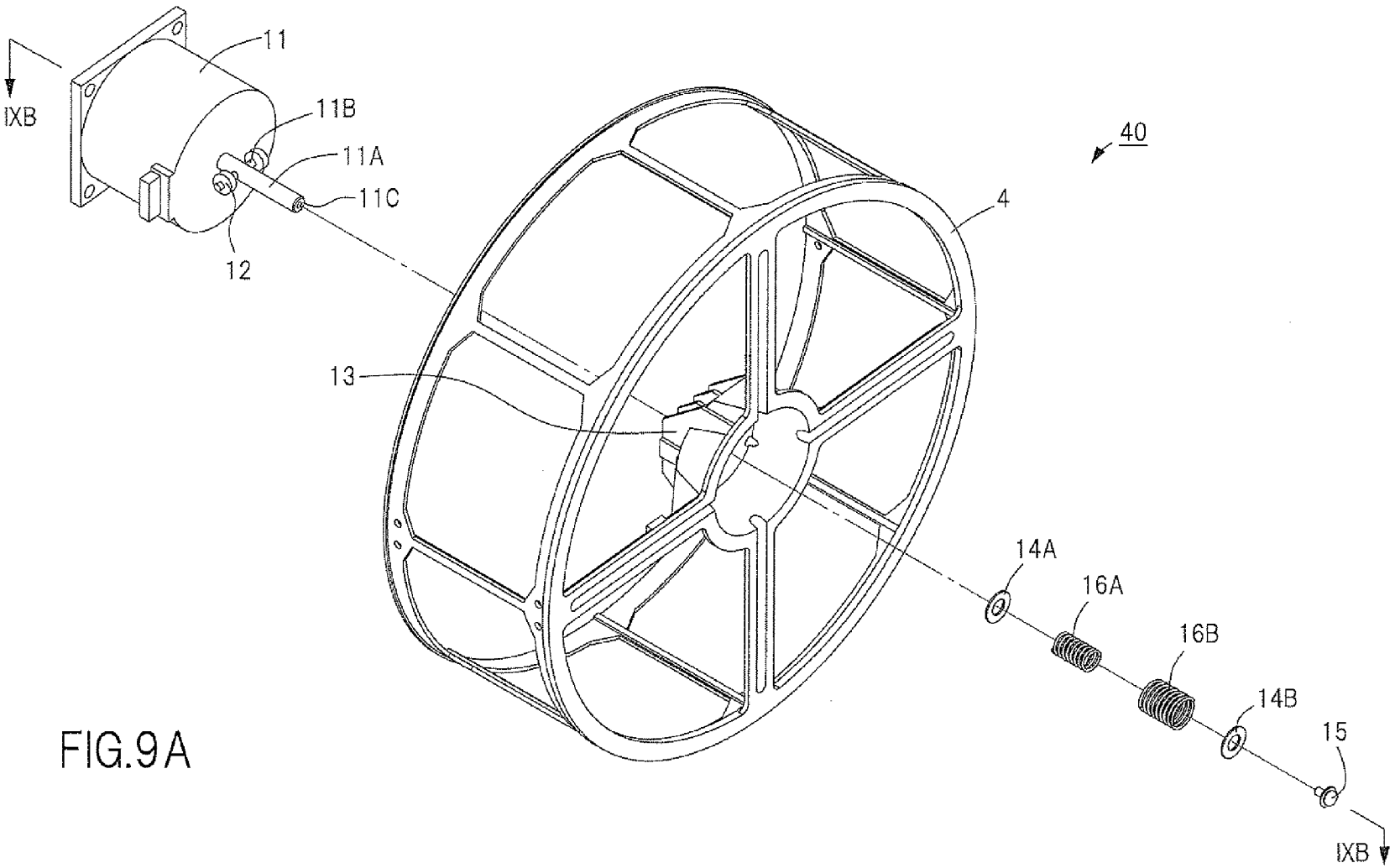
FIG. 9A is an exploded perspective view of a reel assembly according to Embodiment 4 of the present invention.
Figure 9B:
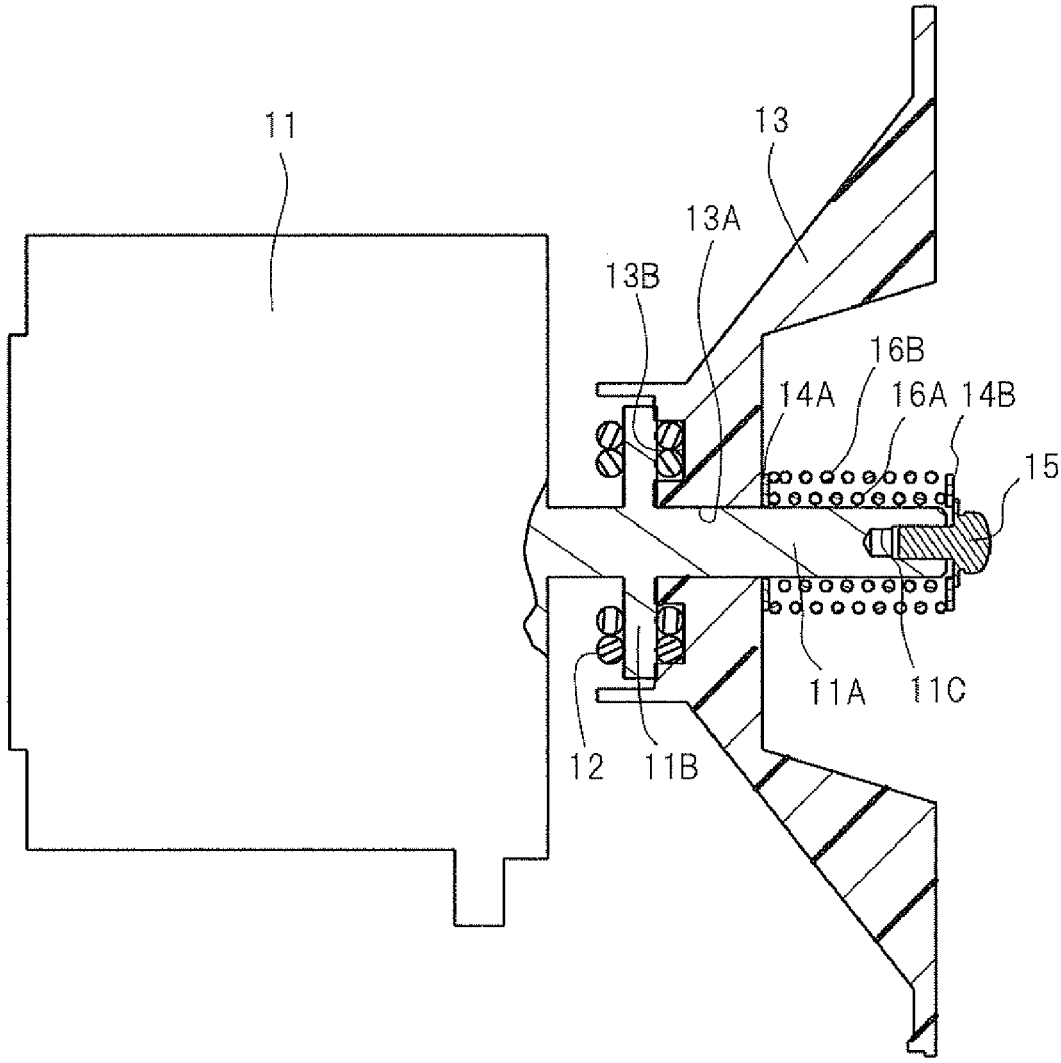
FIG. 9B is a fragmentary cross sectional view taken along lines IXB-IXB of FIG. 9A.

In FIGS. 9A and 9B, the fastening member has the structure similar to that shown in FIGS. 4A and 4B. Alternatively, the fastening member may have any structure similar to those shown in FIGS. 5A, 5B, 6A, 6B, 7A, and 7B.

In the above-described embodiments, the reel assembly according to the present invention is installed in a slot machine. Alternatively, the reel assembly may be used for the reel assemblies in other gaming machines, such as the wheel assemblies for roulette machines, and those of other apparatuses.

GENERAL INTERPRETATION OF TERMS

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A game machine having a reel assembly, the reel assembly comprising:
   - a motor including a shaft;
   - a reel configured to be rotatably coupled to the shaft;
   - a joint between the shaft and the reel wherein the motor exerts torque on the reel; and
   - a fastening member which is coupled to the tip of the shaft, the fastening member including two coil springs of differing diameters arranged at concentric positions with respect to the shaft, wound in opposite circumferential directions of the shaft, and deformable in the axial directions of the shaft, and which is configured to press the reel in the axial direction through elastic deformation of the coil springs and thereby secure the reel on the shaft.

2. A reel assembly according to claim 1, wherein the fastening member allows the lengths of the coil springs to be adjusted in the axial direction.

3. A reel assembly according to claim 2, further comprising a lubricating layer positioned on one of the radially opposed surfaces of the reel and the shaft or between the surfaces thereof.

4. A reel assembly according to claim 1, wherein:
   - a thread is formed at the tip of the shaft; and
   - the fastening member includes a screw or nut coupled to the thread, and thereby presses the coil springs against the reel.

5. A reel assembly according to claim 1, wherein the fastening member includes a plate positioned between the coil springs and the reel.

6. A reel assembly according to claim 5 wherein a protrusion and a depression are formed on the surfaces of the plate and the reel that are in contact with each other, respectively, or vice versa.

7. A gaming machine comprising a plurality of reel assemblies, each of which comprising:

a motor including a shaft;

a reel configured to be rotatably coupled to the shaft;

a joint between the shaft and the reel wherein the motor exerts torque on the reel; and a fastening member which is coupled to the tip of the shaft, the fastening member including two coil springs of differing diameters arranged at concentric positions with respect the shaft, wound in opposite circumferential directions of the shaft, and deformable in the axial directions of the shaft, and which is configured to press the reel in the axial direction through elastic deformation of the coil springs and thereby secure the reel on the shaft.

* * * * *